US005848597A

United States Patent [19]

Carpenter

[11] Patent Number: 5,848,597

[45] Date of Patent: Dec. 15, 1998

[54] NAIL WRAP MOLDER

[76] Inventor: June Carpenter, 11 Cindy St., Old Bridge, N.J. 08857

[21] Appl. No.: 974,051

[22] Filed: Nov. 19, 1997

[51] Int. Cl.[6] ..... A45D 29/06

[52] U.S. Cl. ..... 132/73; 132/285

[58] Field of Search ..... 132/319, 285, 132/73, 73.5

[56] References Cited

U.S. PATENT DOCUMENTS

| | | | |
|---|---|---|---|
| 2,799,282 | 7/1957 | Slack | 132/285 |
| 4,132,234 | 1/1979 | Bradley | 132/73 |
| 4,287,899 | 9/1981 | Robichaud | 132/73 |
| 4,524,789 | 6/1985 | Sazdanoff | 132/73 |
| 4,690,369 | 9/1987 | Giuliano | 132/73 |
| 5,184,795 | 2/1993 | Sexton | 132/73 |
| 5,613,507 | 3/1997 | Geer et al. | 132/73 |

*Primary Examiner*—Todd E. Manahan

[57] ABSTRACT

A new nail wrap molder for helping form silk wraps on a fingernail to match the natural contour of the fingernail. The inventive device includes an elongate base portion and a form portion extending from the upper surface of the base portion. The form portion has an arcuate upper forming surface designed for resting a fingernail on to permit the application and forming of a silk wrap or artificial nail on the fingernail. The form portion also has an abutment wall orientated towards the proximal end of the base portion which is designed for abutting the tip of a finger against it when the fingernail to be molded rests upon the arcuate upper forming surface of the form portion.

14 Claims, 2 Drawing Sheets

NAIL WRAP MOLDER

BACKGROUND OF THE INVENTION

1. Field of the Invention

The present invention relates to nail forms and more particularly pertains to a new nail wrap molder for helping form silk wraps on a fingernail to match the natural contour of the fingernail.

2. Description of the Prior Art

The use of nail forms is known in the prior art. More specifically, nail forms heretofore devised and utilized are known to consist basically of familiar, expected and obvious structural configurations, notwithstanding the myriad of designs encompassed by the crowded prior art which have been developed for the fulfillment of countless objectives and requirements.

Known prior art nail forms include U.S. Pat. No. 4,172,461; U.S. Pat. No. 5,005,595; U.S. Pat. No. Des. 300,066; U.S. Pat. No. 4,140,139; U.S. Pat. No. 4,696,316; and U.S. Pat. No. 5,003,997.

While these devices fulfill their respective, particular objectives and requirements, the aforementioned patents do not disclose a new nail wrap molder. The inventive device includes an elongate base portion and a form portion extending from the upper surface of the base portion. The form portion has an arcuate upper forming surface designed for resting a fingernail on to permit the application and forming of a silk wrap or artificial nail on the fingernail. The form portion also has an abutment wall orientated towards the proximal end of the base portion which is designed for abutting the tip of a finger against it when the fingernail to be molded rests upon the arcuate upper forming surface of the form portion.

In these respects, the nail wrap molder according to the present invention substantially departs from the conventional concepts and designs of the prior art, and in so doing provides an apparatus primarily developed for the purpose of helping form silk wraps on a fingernail to match the natural contour of the fingernail.

SUMMARY OF THE INVENTION

In view of the foregoing disadvantages inherent in the known types of nail forms now present in the prior art, the present invention provides a new nail wrap molder construction wherein the same can be utilized for helping form silk wraps on a fingernail to match the natural contour of the fingernail.

The general purpose of the present invention, which will be described subsequently in greater detail, is to provide a new nail wrap molder apparatus and method which has many of the advantages of the nail forms mentioned heretofore and many novel features that result in a new nail wrap molder which is not anticipated, rendered obvious, suggested, or even implied by any of the prior art nail forms, either alone or in any combination thereof.

To attain this, the present invention generally comprises an elongate base portion and a form portion extending from the upper surface of the base portion. The form portion has an arcuate upper forming surface designed for resting a fingernail on to permit the application and forming of a silk wrap or artificial nail on the fingernail. The form portion also has an abutment wall orientated towards the proximal end of the base portion which is designed for abutting the tip of a finger against it when the fingernail to be molded rests upon the arcuate upper forming surface of the form portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new nail wrap molder apparatus and method which has many of the advantages of the nail forms mentioned heretofore and many novel features that result in a new nail wrap molder which is not anticipated, rendered obvious, suggested, or even implied by any of the prior art nail forms, either alone or in any combination thereof.

It is another object of the present invention to provide a new nail wrap molder which may be easily and efficiently manufactured and marketed.

It is a further object of the present invention to provide a new nail wrap molder which is of a durable and reliable construction.

An even further object of the present invention is to provide a new nail wrap molder which is susceptible of a low cost of manufacture with regard to both materials and labor, and which accordingly is then susceptible of low prices of sale to the consuming public, thereby making such nail wrap molder economically available to the buying public.

Still yet another object of the present invention is to provide a new nail wrap molder which provides in the apparatuses and methods of the prior art some of the advantages thereof, while simultaneously overcoming some of the disadvantages normally associated therewith.

Still another object of the present invention is to provide a new nail wrap molder for helping form silk wraps on a fingernail to match the natural contour of the fingernail.

Yet another object of the present invention is to provide a new nail wrap molder which includes an elongate base portion and a form portion extending from the upper surface of the base portion. The form portion has an arcuate upper forming surface designed for resting a fingernail on to permit the application and forming of a silk wrap or artificial nail on the fingernail. The form portion also has an abutment wall orientated towards the proximal end of the base portion which is designed for abutting the tip of a finger against it when the fingernail to be molded rests upon the arcuate upper forming surface of the form portion.

Still yet another object of the present invention is to provide a new nail wrap molder that provides a sanitary surface for applying silk wraps to a fingernail so that a manicurist does not have to touch the silk wrap while forming it to the fingernail.

Even still another object of the present invention is to provide a new nail wrap molder that includes an optional clip on embodiment that provides a nail for that is attachable to the finger that the silk wrap is being applied to.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
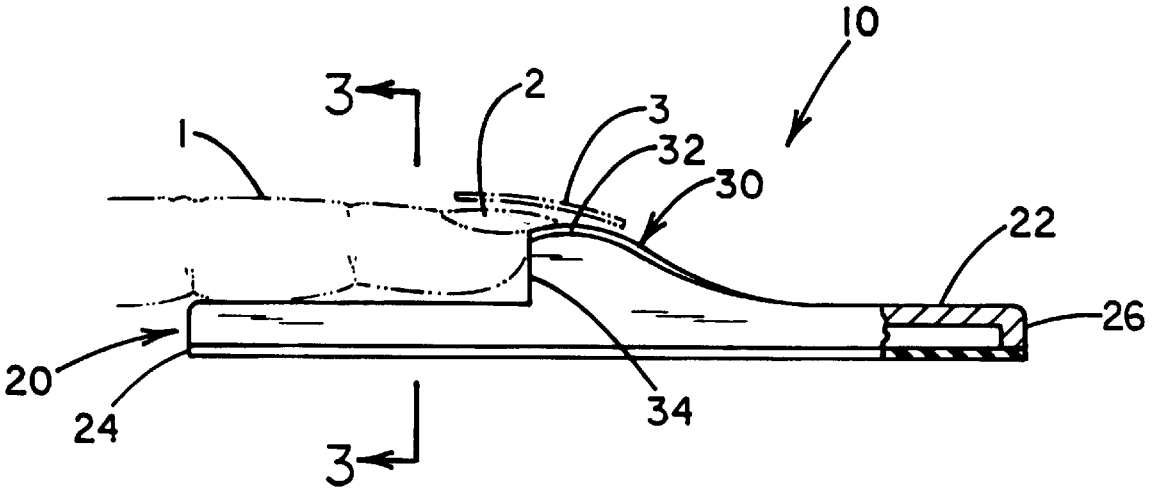
FIG. 1 is a side view of a new nail wrap molder according to the present invention illustrating its use in applying a silk wrap to a nail.
Figure 2:
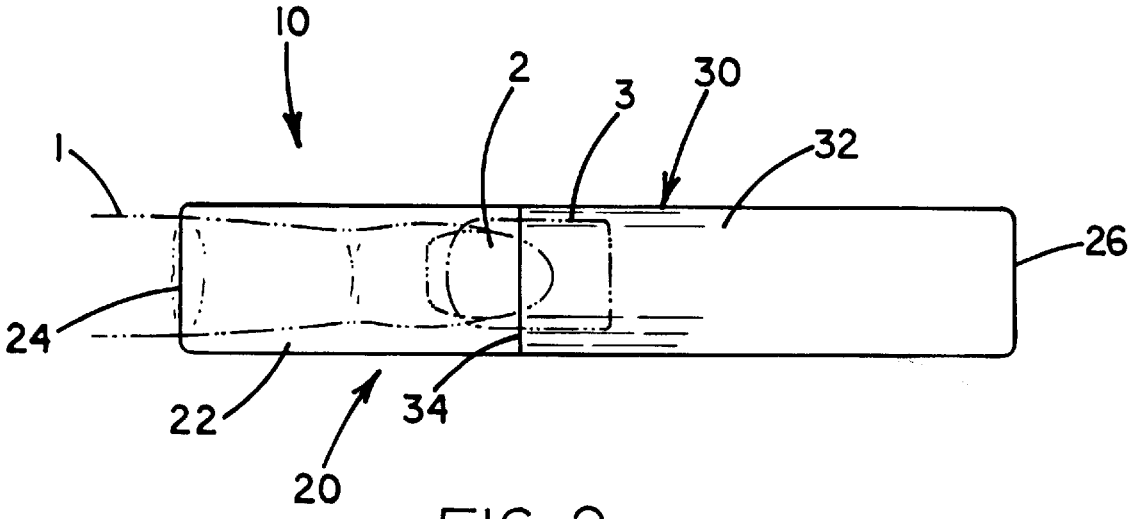
FIG. 2 is a top view of the present invention.
Figure 3:
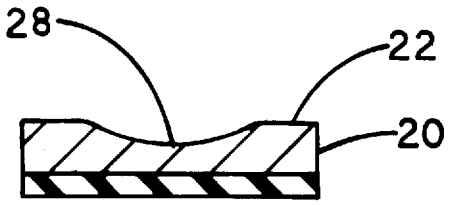
FIG. 3 is a cross section view of the present invention taken from line 3—3 on FIG. 1.

With reference now to the drawings, and in particular to FIGS. 1 through 4 thereof, a new nail wrap molder embodying the principles and concepts of the present invention and generally designated by the reference numeral 10 will be described.

As best illustrated in FIGS. 1 through 4, the nail wrap molder 10 generally comprises an elongate base portion 20 and a form portion 30 extending from the upper surface 22 of the base portion. The form portion 30 has an arcuate upper forming surface 32 designed for resting a fingernail 2 on to permit the application and forming of a silk wrap or artificial nail 3 on the fingernail. The form portion 30 also has an abutment wall 34 orientated towards the proximal end 24 of the base portion which is designed for abutting the tip of a finger 1 against it when the fingernail 2 to be molder rests upon the arcuate upper forming surface of the form portion 32.

Preferably, the thickness of the form portion 30 is tapered towards the distal end 26 of the base portion. In this preferred embodiment, the width of the form portion 30 also extends across the width of the base portion 20.

Ideally, the upper surface of the base portion 22 has a depression 28 for resting a finger 1 therein. Preferably, the depression 28 extends between the proximal end of the base portion 24 and the abutment wall of the form portion 34 to comfortably fitting a finger 1 within it.

In the preferred embodiment of the invention, the lower surface of the base portion comprises a non-skid material for providing a non-skid resting surface Ideally, the lower surface is made of rubber. Also ideally, the upper surfaces of the base portion and the forming portion 22,32 are made from a metal such as steel to help prevent a silk wrap 3 from adhering to the invention when the silk wrap 3 is glued to a fingernail 2.

Figure 4:
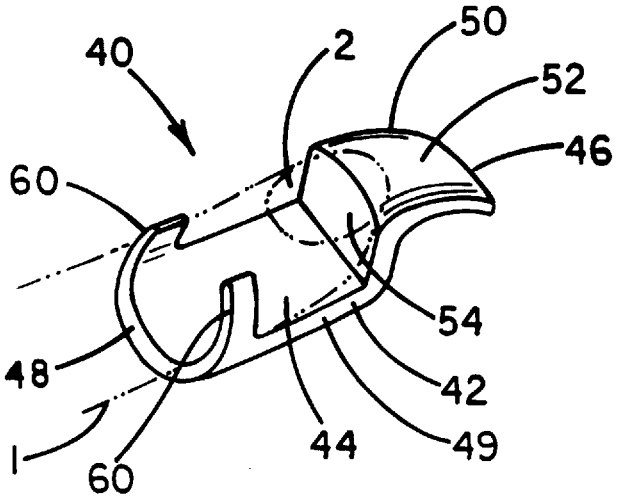
FIG. 4 is a perspective view of the clip on embodiment of the present invention.

FIG. 4 depicts an optional clip-on embodiment 40 of the nail wrap molder. In this embodiment, the nail form 40 includes an elongate base portion 42, a form portion 50, and a pair of opposed finger encompassing arms 60. The form portion 50 has an arcuate upper forming surface 52 and an abutment wall 54. The abutment wall 54 extends from the upper surface of the base portion 44. The abutment wall 54 is designed for abutting against the tip of a finger resting on the upper surface of the base portion 44 so that the fingernail 2 rests on the upper forming surface 52. Preferably, the abutment wall 54 is positioned towards the distal end 46 of the base portion with the upper forming surface being extended away from the proximal end of the base portion 48.

The finger encompassing arms 60 each extend from both lateral sides 49 of the base portion. The finger encompassing arms 60 are designed for holding a finger 1 positioned between them to the base portion 42. Preferably, the finger encompassing arms 60 are located towards the proximal end of the base portion 48.

In using the nail wrap molder 10, a finger 1 is placed on the upper surface of the base portion 22 so that the finger 1 rests within the depression 28. The finger 1 is positioned on the upper surface 22 so that the tip of the finger abuts the abutment wall 34 and the fingernail 2 rests on the upper forming surface 32. A silk wrap 3 may then be applied to the fingernail 3 on the upper forming surface 32. The silk wrap 3 may then be molded on the upper forming surface to match the natural contours of the fingernail 2. Also in use, the invention 10 may be rested on a surface or the base portion 20 can be grasped by a user towards the distal end of the base portion 26.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A nail form, comprising:

an elongate base portion having a proximal end, a distal end, an upper surface, a lower surface;

a form portion having an arcuate upper forming surface and an abutment wall, said form portion being extended from said upper surface of said base portion, said abutment wall of said form portion being orientated towards said proximal end of said base portion, said abutment wall of said form portion being for abutting the tip of a finger thereagainst, said upper forming surface of said form portion being for resting a fingernail thereon; and said abutment wall of said form portion being substantially flat and being oriented substantially perpendicular to said upper surface of said base portion for resisting slippage of said tip of said finger past said abutment wall and onto said form portion.

2. The nail form of claim 1, wherein said lower surface comprises a non-skid material to provide a non-skid resting surface.

3. The nail form of claim 2, wherein said lower surface comprises rubber.

4. The nail form of claim 1, wherein the width of said form portion is extended across the width of said base portion.

5. The nail form of claim 1, wherein the thickness of said form portion is tapered towards said distal end of said base portion.

6. The nail form of claim 1, wherein said upper surface of said base portion has a depression for resting a finger therein.

7. The nail form of claim 6, wherein said depression of said upper surface is extended between said proximal end of said base portion and said abutment wall of said form portion.

8. The nail form of claim 1, wherein said base portion has a pair of base sides, said base sides being parallel each other, said form portion having a pair of form sides, said form sides being parallel each other, said upper forming surface of said form portion extending between said form sides of said form portion.

9. The nail form of claim 1, wherein said base member and said form portion comprise a surface adapted to resist adhesion of adhesives thereto.

10. A nail form, comprising:

an elongate base portion having a proximal end, a distal end, an upper surface, a lower surface, said lower surface comprising rubber to provide a non-skid resting surface;

a form portion having an arcuate upper forming surface and an abutment wall, said form portion being extended from said upper surface of said base portion, the width of said form portion being extended across the width of said base portion, said form portion being tapered towards said distal end of said base portion, said abutment wall of said form portion being orientated towards said proximal end of said base portion, said abutment wall of said form portion being substantially flat, said abutment wall of said form portion being for abutting the tip of a finger thereagainst, said upper forming surface of said form portion being for resting a fingernail thereon;

said upper surface of said base portion having a depression for resting a finger therein, said depression of said upper surface being extended between said proximal end of said base portion and said abutment wall of said form portion;

said base portion having a pair of base sides, said base sides being parallel each other;

said form portion having a pair of form sides, said form sides being parallel each other;

said upper forming surface of said form portion extending between said form sides of said form portion; and said base member and said form portion comprising a surface adapted to resist adhesion of adhesives thereto.

11. A nail form, comprising:

an elongate base portion having a proximal end, a distal end, a pair of lateral sides, and an upper finger resting surface, said base portion having a longitudinal axis;

a form portion having an arcuate upper forming surface and an abutment wall, said abutment wall of said form portion being extended from said upper surface of said base portion, said abutment wall of said form portion being for abutting the tip of a finger thereagainst, said upper forming surface of said form portion being for resting a fingernail thereon; and a pair of opposed finger embracing arms, each said finger embracing arm being extended from a said lateral side of said base portion in a direction toward the other said finger embracing arm, said finger embracing arms being oriented generally perpendicular said longitudinal axis of said base portion for holding said base portion to a finger inserted between said opposed finger embracing arms when said base portion is lifted free from a supporting surface.

12. The nail form of claim 11, wherein said abutment wall of said form portion is positioned towards the distal end of said base portion.

13. The nail form of claim 11, wherein said finger encompassing arms are located towards said proximal end of said base portion.

14. The nail form of claim 13, wherein said opposed fingers are curved for closely fitting against sides of a finger.

* * * * *